United States Patent [19]

Hong et al.

[11] 4,125,088

[45] Nov. 14, 1978

[54] AUTOMATIC SPRAY COATING MACHINE

[75] Inventors: Sung D. Hong, Escondido; Ray Boggs, Lemon Grove; Shinzo Takei, Escondido, all of Calif.

[73] Assignee: Sony Corporation, Tokyo, Japan

[21] Appl. No.: 761,420

[22] Filed: Jan. 21, 1977

[51] Int. Cl.[2] ..... B05B 15/04

[52] U.S. Cl. ..... 118/301; 118/318; 118/326; 118/504; 277/34; 427/233

[58] Field of Search ..... 118/301, 317, 318, 320, 118/326, 504; 427/282; 277/34.3, 34

[56] References Cited

U.S. PATENT DOCUMENTS

| | | | |
|---|---|---|---|
| 2,619,430 | 11/1952 | Fink | 118/318 X |
| 2,646,769 | 7/1953 | Lindsay | 118/317 X |
| 2,763,233 | 9/1956 | Hartley et al. | 118/318 X |
| 2,775,869 | 1/1957 | Pointer | 277/34.3 X |
| 3,791,846 | 2/1974 | Nuehring | 118/301 X |
| 3,899,994 | 8/1975 | Cook et al. | 118/326 X |
| 4,029,425 | 6/1977 | Pelsue | 404/25 |

*Primary Examiner*—Mervin Stein

*Attorney, Agent, or Firm*—Lewis H. Eslinger; Alvin Sinderbrand

[57] ABSTRACT

A device for coating, with a carbon material, the inner surface of a cathode ray tube having a neck and flared or cone end portion which is opened at its end remote from the neck along a free peripheral edge portion to which the front panel of the completed cathode ray tube is later secured. The device includes a frame on which a turntable is rotatably mounted and supports, for rotation therewith, a seal assembly for selectively forming a seal on the inner surface of the flared portion of the cathode ray tube adjacent the free edge thereof. The tube is supported on the turntable adjacent the seal assembly along its peripheral edge, and the assembly includes an expandable seal strip generally complementary to the internal configuration of the tube along which the seal is to be formed, so that upon expansion of the seal strip a tight seal is formed against the tube. The device includes a coating mechanism, as for example spray nozzles for coating the inner surface of the tube after the seal is formed, whereby the seal prevents the sealed or masked portion of the tube from being coated with the coating material.

37 Claims, 11 Drawing Figures

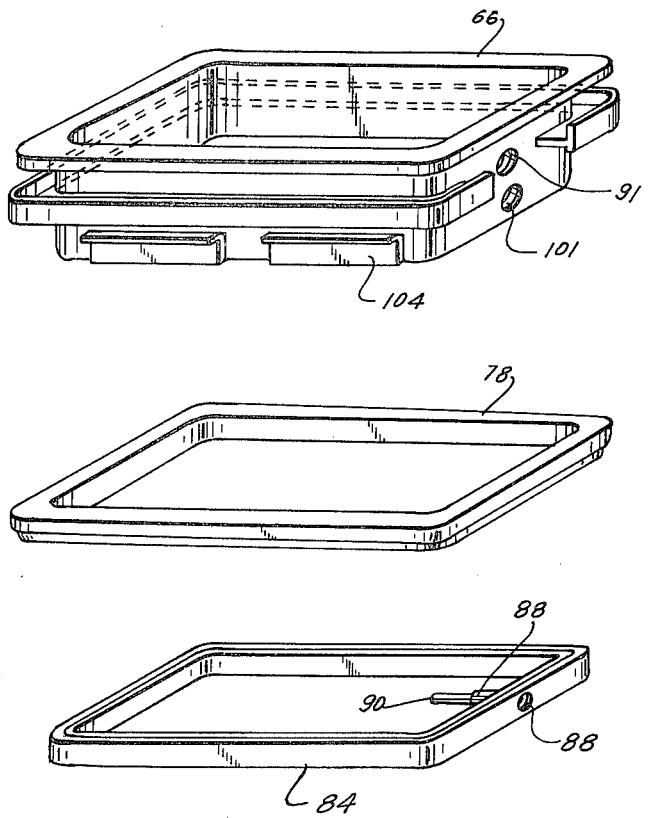
FIG. 2
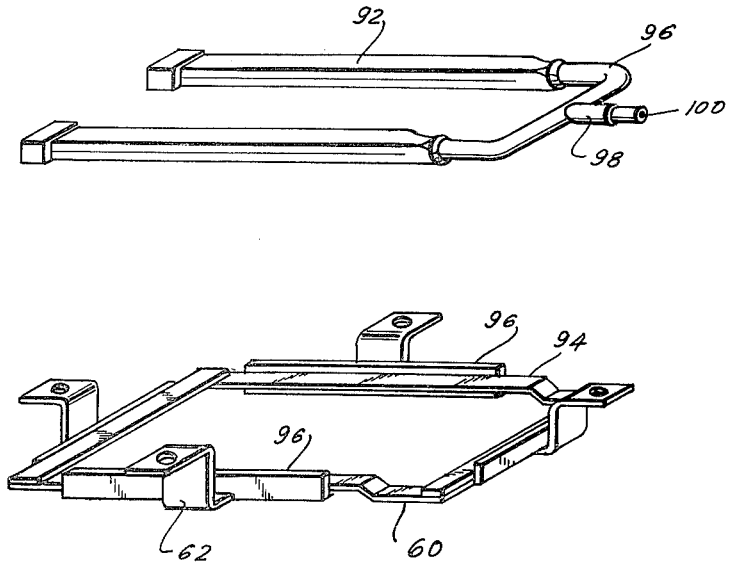

FIG. 3A
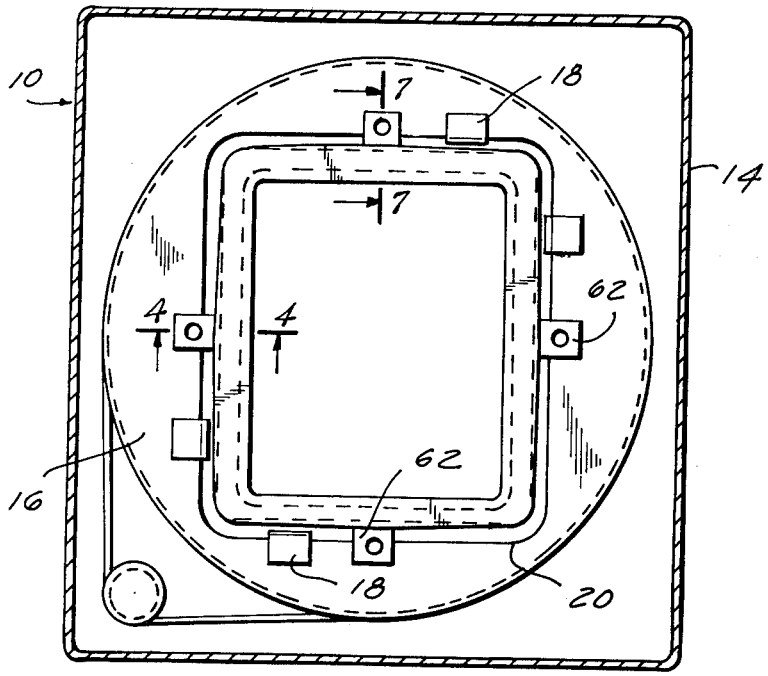
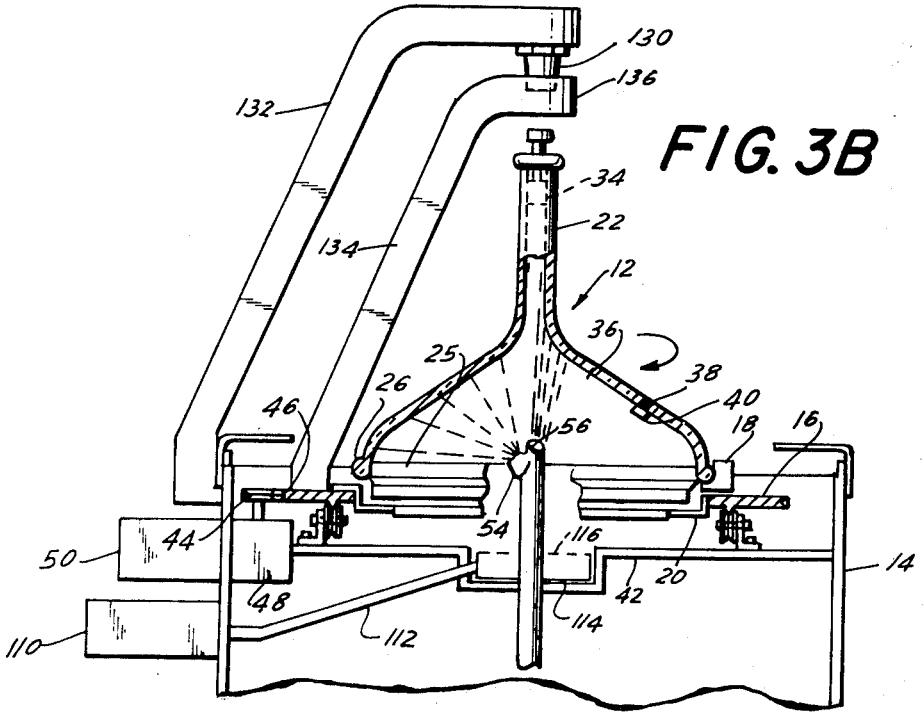
FIG. 3B

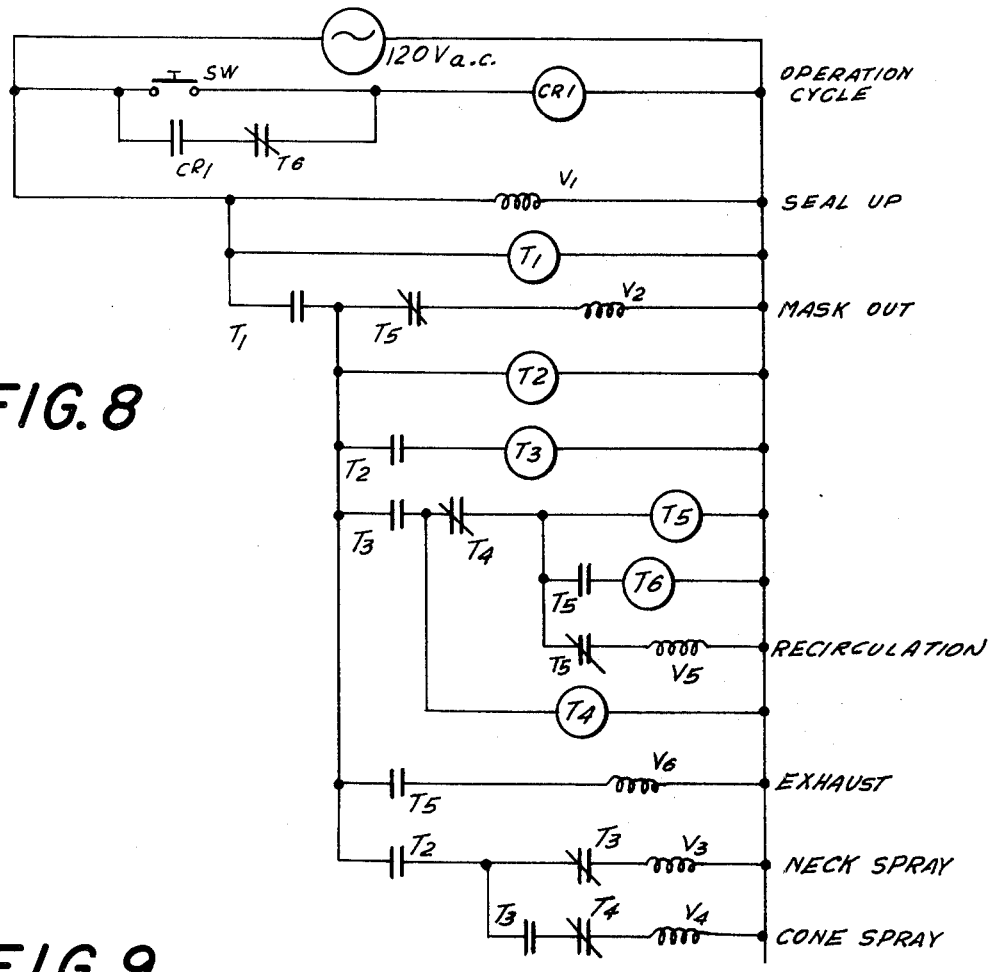
FIG. 8
FIG. 9
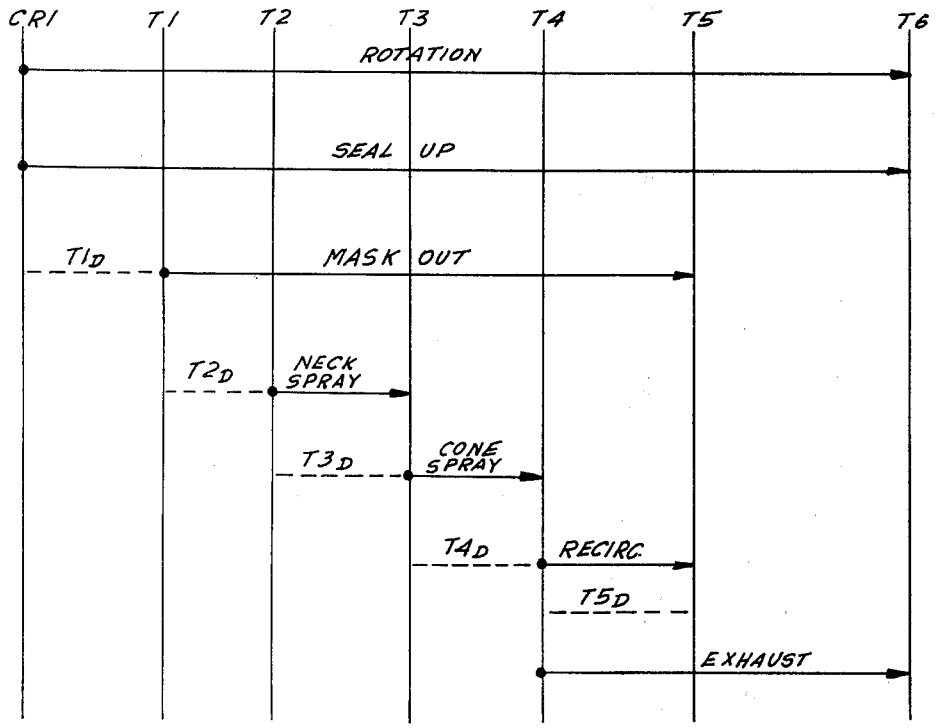

AUTOMATIC SPRAY COATING MACHINE

The present invention relates to a device for automatically coating the inner surface of a cathode ray tube during the manufacturing operation and, more particularly, to a device for automatically masking the frit edge of the cone or flared portion of a cathode ray tube.

The typical cathode ray tube, and particularly those used for color television, are composed of a front panel containing a phosphorous screen and a funnel portion containing the neck and cone or flared portion of the tube in which the electron gun or guns are mounted. The panel and funnel of the tube are separately formed and must be sealed to make the completed tube. This seal is usually formed by the frit sealing process, in the well known manner, and therefore the seal edges of both the panel and funnel must be uniformly curved and perfectly flat. They must also be free of all surface impurities.

In the manufacturing process for cathode ray tubes an inner carbon coating is applied to the inner surface of the funnel. Coating of such tubes has been performed in the past with a thin film of conductive carbon, by either brushing or spraying the carbon material onto the inner surface of the funnel. The purpose of this coating, as is well known in the art, is to maintain the potential anode voltage within the cathode ray tube and to conduct this voltage to a portion of the electron gun in the neck of the tube. This voltage is extremely high and usually is between 18 to 30 kv.

When a cathode ray tube is installed in a television set the frit seal edge between the funnel and the front panel becomes zero potential and is connected to ground, while the area immediately adjacent to it, which is coated with carbon, is subjected to the high voltage of the anode. Consequently, between the frit seal and the carbon coating there is a substantial possibility of arcing, if carbon particles have been inadvertently applied too close to the seal edge during the inner carbon coating step. Accordingly it is very important in the manufacture of cathode ray tubes to keep the surface of the seal edge and the surrounding area absolutely free of carbon particles.

In previously proposed manufacturing processes the sealing or frit edge of the cathode ray tube is protected from carbon residue during the coating step by using a manually applied masking tape or a specially formed repellent coating. These protective devices are then manually moved upon completion of the carbon coating process. As can be appreciated, these manual operations are very inefficient and time consuming and require a substantial amount of manual labor.

Accordingly, it is an object of the present invention to provide a device for automatically coating the inside surface of a cathode ray tube in the desired areas, while simultaneously forming an automatically removable seal adjacent the frit edge of the tube.

Another object of the present invention is to provide an improved an apparatus for coating the inner surface of a cathode ray tube during the manufacturing process.

Yet another object of the present invention is to provide a seal or masking assembly which will accurately, and repetitively, form a seal or mask adjacent the frit edge of a cathode ray tube during the inner surface coating step of the manufacturing process.

A further object of the present invention is to provide an apparatus of the character described which is relatively simple in construction and durable in use.

A still further object of the present invention is to provide a device of the character described which will substantially reduce the costs of manufacture of cathode ray tubes.

In accordance with an aspect of the present invention a device for coating the inner surface of a cathode ray tube of the type having a neck and a flared or cone end portion, including an open end remote from the neck and defined by a free peripheral frit edge portion to which the front tube panel is secured after coating, includes a base on which a turntable is rotatably mounted for supporting the cathode ray tube along its free edge adjacent the opening in the flared end portion of the tube. The turntable has an opening formed therein at the position in which the cathode ray tube is supported, and a seal or masking assembly is mounted on the turntable in this opening for selectively forming a seal or mask on the inner surface of the flared portion of the cathode ray tube adjacent its free frit peripheral edge.

The seal assembly includes a first frame element which is secured to the turntable for rotation therewith and a second frame element that is slidably mounted on the first frame element for vertical movement with respect to the first frame element and the turntable. A flexible sealing or masking strip is mounted around the second frame element and has an exterior peripheral configuration, in plan, which is generally complementary to the internal peripheral configuration of the portion of the cathode ray tube to be masked. Means are provided in this assembly for moving the second frame element and the sealing strip thereon vertically away from the first frame element through the opened end of the cathode ray tube in a predetermined level adjacent the portion of the tube to be masked. And, means are also provided for expanding the sealing strip after it has been moved vertically in this manner, laterally outwardly with respect to the second frame element into sealing engagement with the portion of the cathode ray tube to be masked.

Spray nozzles or the like are provided in the base of the device adjacent the opening of the turntable for spraying carbon coating material onto the inner surface of the cathode ray tube whereby the masking strip prevents the portion of the cathode ray tube with which it is engaged from being coated with carbon material.

The above, and other objects, features and advantages of this invention will be apparent in the following detailed description of an illustrative embodiment thereof, which is to be read in conjunction with the accompanying drawings, wherein:

FIG. 2 is an exploded perspective view of a masking or sealing assembly, constructed in accordance with the present invention, used in the device of FIG. 1;

FIG. 3A is a plan view of the assembled masking device of FIG. 2 shown mounted within the device of FIG. 1;

FIG. 3B is a partial sectional view taken along line 3B—3B of FIG. 1;

FIG. 8 is a schematic circuit diagram of the circuit used to control the apparatus of the present invention;

FIG. 9 is a time chart illustrating the sequence of operations of the elements of the present invention.

Figure 1:
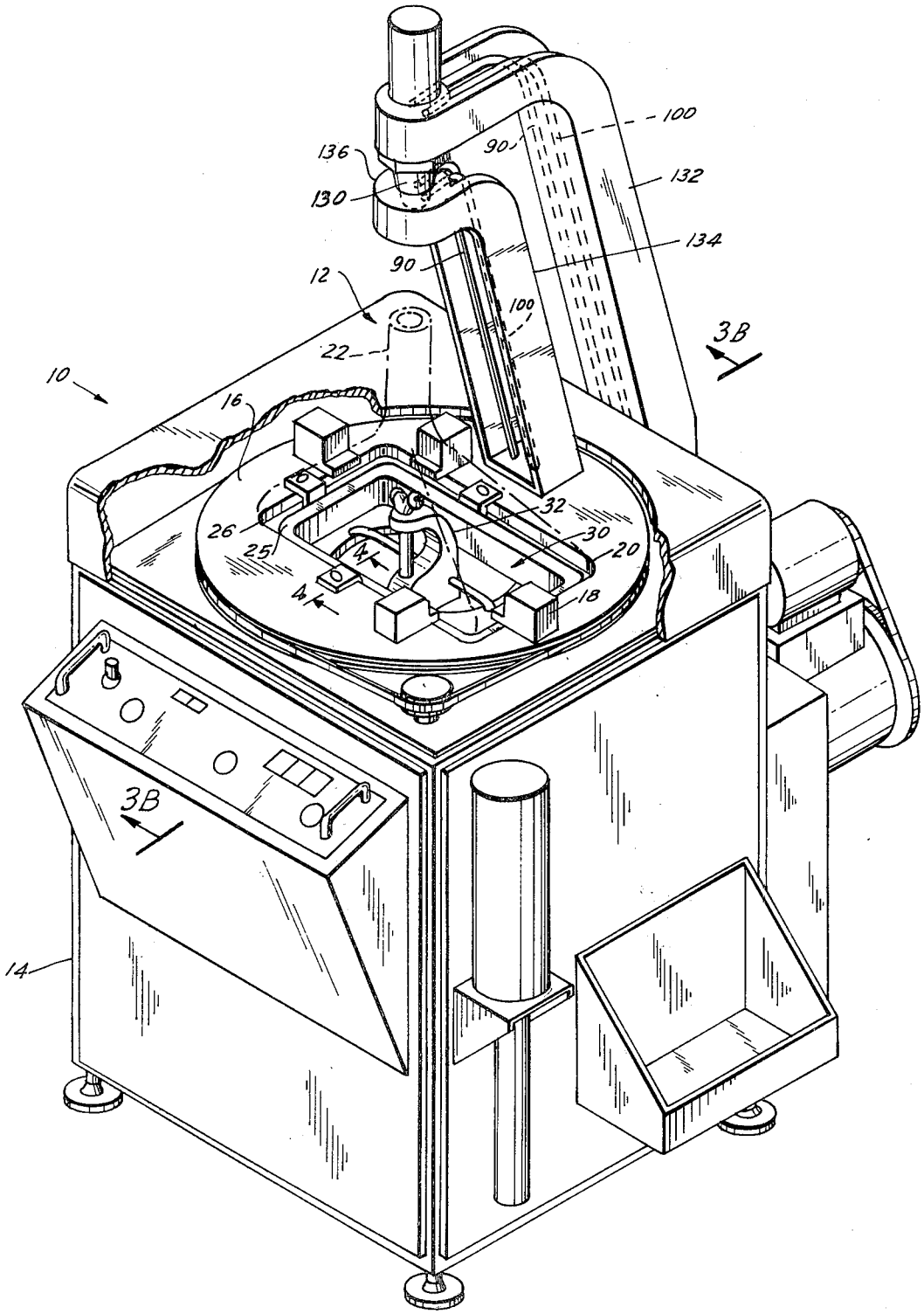
FIG. 1 is a perspective view, with parts broken away for clarity, of an automatic coating machine constructed in accordance with the present invention.

Referring now to the drawings in detail, and initially to FIG. 1 thereof, an apparatus 10 for use in spray coating the interior surfce of a cathode ray tube 12 includes a base 14 and a turntable 16 rotatably mounted on the base. The turntable provides a plurality of locating blocks 18 adjacent a central opening 20 formed therein for supporting the cathode ray tube in a predetermined position aligned with the opening 20.

The cathode ray tube is of generally conventional construction and consists of a funnel having a neck portion 22 and a cone or flared portion 24 which has an open end 25 defined by a peripheral frit edge 26 that is seated on the shoulders 28 of the locating and support blocks 18.

As previously mentioned, during the manufacturing process of cathode ray tubes the front panel is not secured to the frit edge 26 of the tube until after the interior surface of the tube has been coated with a carbon conductive material. The apparatus 10 is constructed to automatically coat the desired portions of the inner surface of the tube 22, while simultaneously masking the inner surface of the tube adjacent the frit edge 26 to insure that none of the sprayed on carbon material is applied to this frit edge, where it could interfere with the frit sealing process or with the operation of the completed tube.

In accordance with a feature of the present invention, turntable 16 has a masking assembly or cassette 30 mounted thereon for rotation therewith. The masking assembly is constructed and controlled, as described hereinafter, to rise through the opening 25 at the front end of the flared portion 24 of the tube and expand outwardly to form a tight seal or mask against a predetermined portion of the tube near edge 26. After the seal is made a spraying head 32 is operated to spray the carbon conductive material, such as for example iron oxide carbon, onto the inner surface of the tube.

The neck 22 of tube 12 (see FIG. 3B) is closed by a manually removable plug 34, prior to operation or rotation of the turntable 16, so that the area of spraying on the internal surface 36 of the tube in the neck is limited to a defined location. In addition, in certain types of cathode ray tubes, an aperture 38 is provided in the flared portion of the tube for introduction of convergence voltage and high voltage to the electron gun within the tube. This aperture and the area around the aperture must not be coated with carbon, in order to insure against shorting between the high voltage applied to the inner surface of the tube and the convergence voltage applied to the electron gun. For this reason a manually removable plug or button 40 is provided which is adapted to snap fit in the opening 38 in any convenient manner. This button is applied to the opening 38 before the tube 12 is mounted on the locating blocks 18.

Referring again to FIG. 3B, turntable 16 is rotatably mounted within the base or frame 14, in any convenient manner.

As mentioned, the turntable has an opening 20 which is slightly larger in its peripheral configuration than the dimensions of the opening 25 in the opened end of the cone portion 24 of the cathode ray tube 12, adjacent the peripheral edge 26 thereof. The spraying head 32 which is located in opening 20 includes a pair of spray nozzles 54, 56, mounted in the base 14 in any convenient manner, and connected to a source of the carbon material to be sprayed. The nozzles extend upwardly through the support plate 42 and opening 20 in the turntable and are positioned to spray the inner surface 36 of the cathode ray tube during operation of the device.

Figure 4:
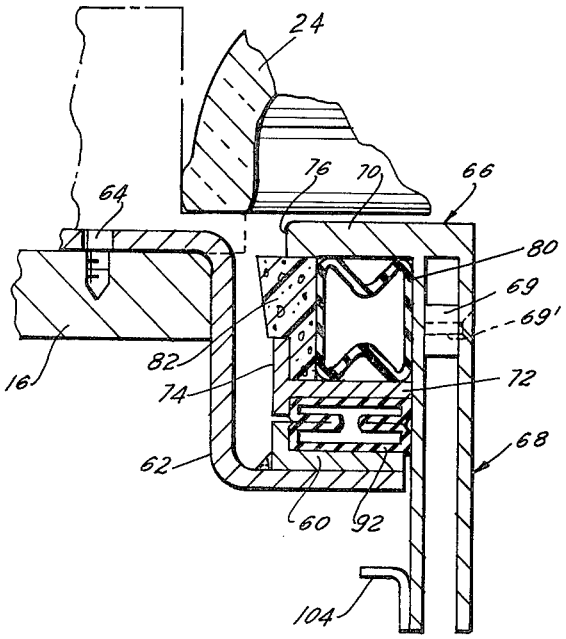
FIG. 4 is an enlarged sectional view taken along line 4—4 of FIG. 1, showing the configuration of the masking assembly components prior to actuation.

In order to form the masking seal along the inner surface of the edge 26 of the cathode ray tube, the masking assembly 30, illustrated in FIG. 2, is provided. This masking assembly includes a first frame member 60 of generally rectangular configuration, to which a plurality of bent flanges 62 are secured along each of the sides. These flanges are bolted to the top of the turntable, as seen in FIGS. 1 and 4, by bolts 64 or the like, in any convenient manner. This first frame or subframe element 60 of the masking assembly provides the entire support for the remaining elements of the assembly on the turntable and it rotates with the turntable during operation of the device.

A second frame element 66 is supported on frame element 60 for relative vertical movement. The second frame or subframe element 66 is shown in section in FIGS 4–7, wherein it is seen that each of the legs of the generally rectangular frame element has an inverted generally L-shaped configuration including a first or long leg 68 which is dimensioned to be received within the internal periphery of the frame element 60. In the illustrative embodiment of the invention the leg 66 is formed from two metal plates, spaced from each other and reinforced by a spacer 69, secured between the plates by a screw or the like 69′ in any convenient manner. Frame element 66 also includes a second or shorter leg 70 which overlies corresponding portion of frame element 60 in superimposed relation.

Frame element 66 also includes a laterally extending flange 72 secured to long leg 68, by welding or the like. This flange includes an external lip 74 extending parallel to leg 68 but terminating in spaced relation to leg 70, thereby to define a space 76 between lip 74 and leg 70.

A continuous sealing or masking strip 78 formed of a flexible material such as silicone, is located within the space 80 defined between flange 72 and leg 70. This sealing strip has the cross sectional configuration illustrated in FIG. 4 and includes a protruding portion 82 extending outwardly of slot 76. In addition a hollow flexible tube 84, formed of rubber or the like, is positioned within space 80 between leg 68 and sealing strip 82. The tube 84 has a generally rectangular configuration and thus surrounds the four legs 68 of frame 66. The interior of the tube is connected through a nipple 88 and conduit 90 to a source of pressure, as described hereinafter, so that the tube can be selectively expanded. The tube 90 extends through an opening 91 in one of the legs 68 of subframe 66 to the interior of the frame and then back outward through opening 101 to the source of air.

The flange 72 of frame element 66 is supported on a pair of inflatable tubes 92, seated on the long sides 94 of frame element 60. These tubes are retained against lateral movement between the long leg 68 of frame element 66 and lips 96 on the outer sides of the frame member 60. These tubes are connected by a header pipe 96 and nipple 98 to a conduit 100 which is connected to the source of pressure to permit selective inflation of these tubes.

In the operation of the device, masking assembly 30 is activated upon rotation of the turntable 16 so that tube 92 is inflated first. Inflation of the tube raises frame element 66 with respect to frame element 60, into the position shown in FIG. 5. In this manner sealing or masking strip 82 and frame element 66 are raised up through the opening 25 in the cone portion 24 of the cathode ray tube, so that sealing strip 82 is positioned adjacent a predetermined portion 102 of the cathode ray, adjacent the edge 26 thereof. Upward movement of frame element 66 with respect to the frame element 60 is limited by L-shaped stops 104 secured to the sides of frame element 66, as seen in FIG. 2. These stops engage the bottom of frame element 60 and prevent further upward movement. In this connection, in order to permit insertion of frame element 66 in frame element 60, the latter is formed from four separate metal strips or plates respectively defining the sides of the frame, with the ends of these strips being connected by bolts or connecting clips, not shown, in any convenient manner.

Figure 5:
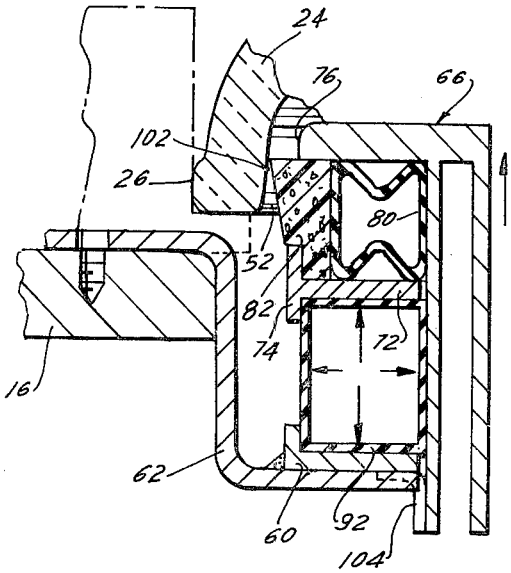
FIG. 5 is a sectional view similar to FIG. 4, showing the raising of the sealing or masking strip in the masking assembly.
Figure 6:
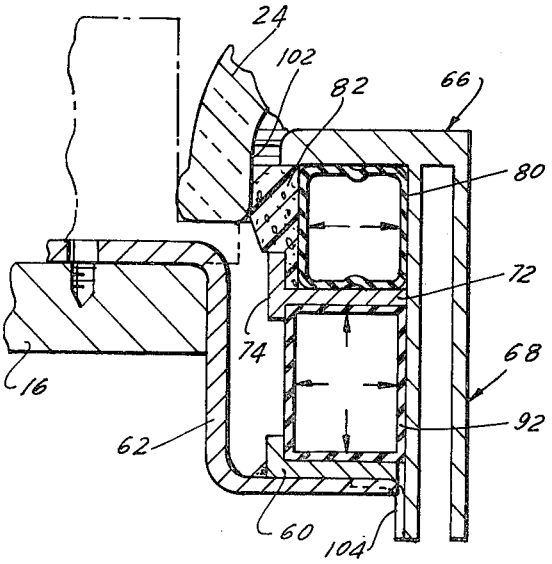
FIG. 6 is a sectional view similar to FIG. 4 showing the next step in the operation wherein the sealing strip is expanded outwardly against the inner surface of the cathode ray tube.
Figure 7:
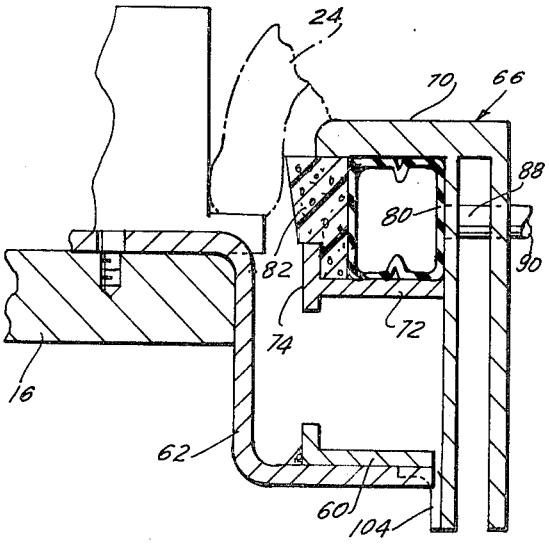
FIG. 7 is a sectional view similar to FIG. 6, showing the connection of the air supply to the tube which expands the masking strip.

Once frame element 66 has reached its uppermost position, as illustrated in FIGS. 5 and 6, air is supplied to the interior of flexible tube 84 in space 80. Expansion of this tube causes lateral expansion of sealing strip 82. This expansion moves sealing strip 78 laterally outwardly, and moves the protrusion portion 82 thereof into engagement with the portion 102 of the cathode ray tube to be masked. The lip 74 on flange 72 prevents the sealing strip from moving entirely out of the space 80, thereby insuring against any possible inadvertent disengagement of the sealing strip from frame element 66. Once the sealing strip 78 is in this position, upon expansion of the tube 84, the spraying process is performed. It is noted that the opening 20 is of sufficient dimensions to permit masking assemblies 30 of different dimensions to be mounted in the opening, so that cathode ray tubes of different sizes can be coated in the same device.

Preferably nozzles 54, 56 of spray head 32 are operated in sequence so that the neck 22 of tube 12 is coated first, by nozzle 56, and thereafter, the cone or flared portion of the tube is spray coated by nozzle 54. With the nozzles being fixed and the turntable rotating, a uniform coating of the entire area of the surface intended to be coated is achieved. The nozzles are preferably operated in sequence, in order to insure that a uniform pressure is applied to the spraying nozzles.

After the spraying operation is completed the internal chambers of tubes 84, 92 are open to the atmosphere and evacuated, so that the masking assembly will return to its original position.

The silicon sealing or masking strip 78 forms a very tight seal against the inner surface of the cathode ray tube. Preferably the sealing strip is dimensioned such that a seal of 5 to 10 millimeters in height is formed. This height is sufficient to insure that no carbon material will pass the seal towards the edge 26 of the cathode ray tube, and thus insures that the edge of the tube remains free of carbon material which would otherwise interfere with the operation of the tube when in use.

After the spraying step is completed, and as the masking assembly returns to its original position, it is desirable to remove air and suspended ambient carbon material from the interior of the tube 12 in order to insure that the coating on the inner surface of the tube remains uniform. This is accomplished by the provision of an exhaust fan 110 (See FIG. 3B) which is connected through a conduit 112 to an exhaust head 114 mounted on support plate 42. The upper surface of head 114 is open, and covered with a foraminous layer of cloth or the like which acts as a filter. When the spraying nozzles are shut off, as described hereinafter, exhaust fan 110 is operated, in order to withdraw suspended carbon from the interior of the tube.

The carbon material used to coat the inner surface of tube 12 is contained in a storage tank (not shown) located within the base of the device. This carbon material will tend to settle to the bottom of the tank and thus a considerable viscosity change will occur in the material during long continual use of the device. In order to prevent this viscosity change and stagnation of the carbon material, it is a feature of the present invention that the carbon material is recirculated through the system, by passing the nozzles, during a period of time in each cycle of operation, when the nozzles are not in use. This is done by using the same pump to recirculate the carbon as is used to project the carbon through the nozzles. In this manner the carbon maintains its viscosity, and remains uniformly mixed.

Referring now to FIG. 9 of the drawing, a time sequence diagram is provided showing the sequence of operation of the elements of applicants' invention. When the apparatus is turned on, by the operation of an on-off switch as described hereinafter, motor 50 is operated to cause rotation of turntable 16. Simultaneously air is supplied to the tubes 92 in order to raise frame element 66 through opening 25 in cathode ray tube 12 and position seal 84 adjacent the portion of the tube to be masked. After passage of a time period T1, frame element reaches its uppermost position of FIG. 5 and air is supplied to tube 84, in order to expand the mask or seal 78. After time T2, the mask has expanded to its full extent and neck spray nozzle 56 is supplied with carbon material in order to spray the neck 22 of tube 12. After a further time period of several seconds, between the time period $T_2$ and $T_3$, nozzle 56 is shut off, and nozzle 54 is activated in order to spray the cone or flared portion of the tube. After the time $T_4$, nozzle 54 is also shut off and the system is placed in its recirculating mode in order to recirculate the carbon material through the system without spraying to insure uniformity of the carbon material for the next operation. At the same time, exhaust fan 110 is activated to remove suspended carbon from the interior of the tube. After the time $T_5$, recirculation of the carbon material is stopped and air is permitted to escape from tube 84. As a result the tube contracts, under the biasing stress of flexible seal elements 78 and a vacuum source applied to tubes 84 and 92. And, after the time period $T_6$ air is permitted to escape from tubes 92, which then collapse under the weight of frame element 66 so that the masking assembly returns to its initial position. At the same time ($T_6$) rotation of turntable 16 is stopped and motor 50 and exhaust fan 110 are shut off.

Figure 10:
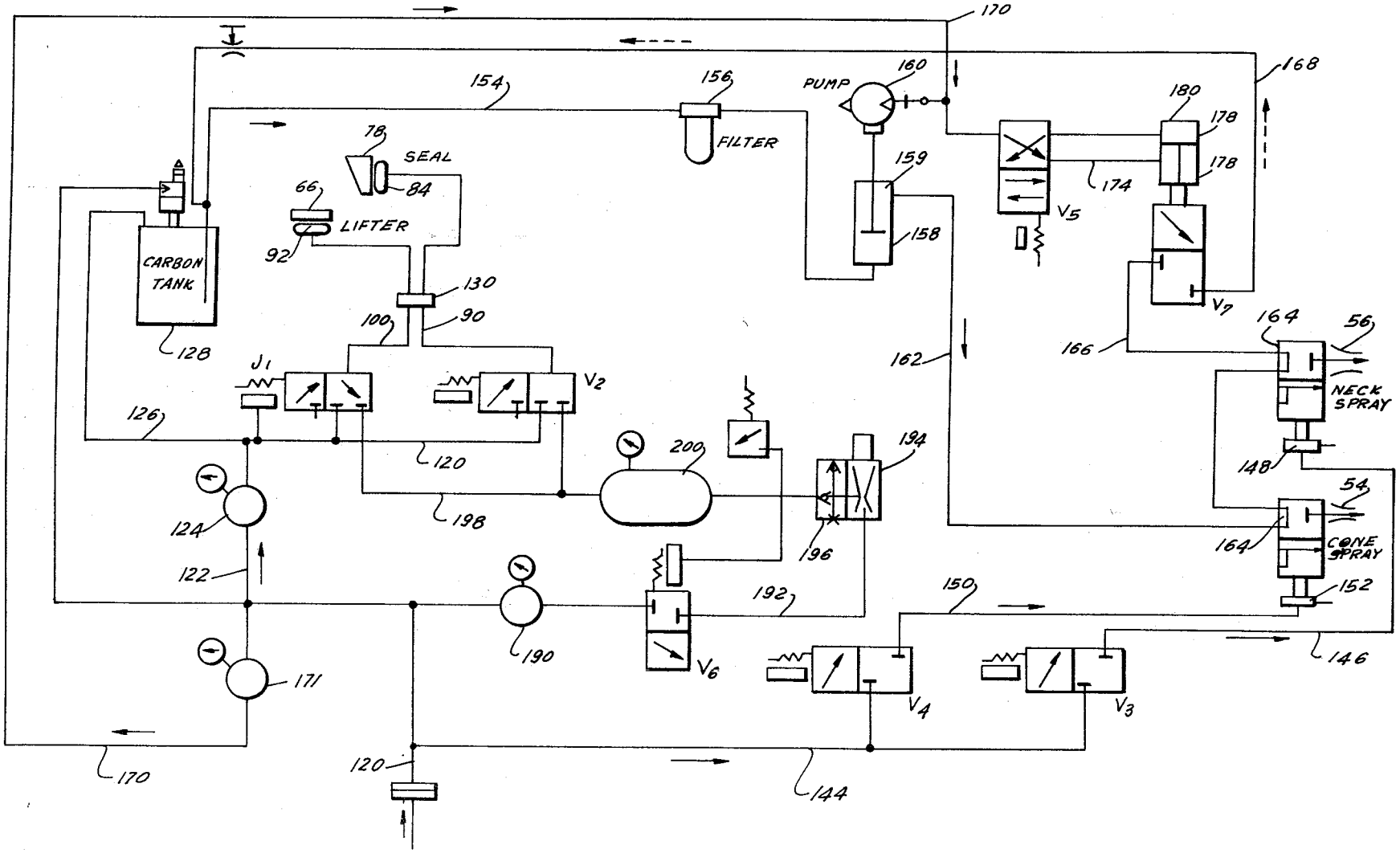
FIG. 10 is a pneumatic circuit diagram of the pneumatic system used to control the operations of the elements of the present invention.

FIGS. 8 and 10 provide the basic electrical pneumatic circuits for the apparatus of the present invention. Referring first to FIG. 10, it is seen that air is supplied through a conduit 120 from a source of pressure, such as an air compressor or shop air (not shown). This air is supplied from conduit 120 to conduit 122 through a pressure regulator 124 to a line 126 which is connected to the storage tank 128 containing the carbon material and to air valves $V_1$ and $V_2$.

Air is transmitted from valves $V_1$ and $V_2$ to tubes 92, 84 through a rotary union 130. This rotary union is illustrated most clearly in FIGS. 1 and 3. As seen therein a support mast 132 is mounted on the base 14 and contains extensions of the air conduits 90, 100. The conduit extensions join the union at their upper ends and supply air to concentric passages in the rotary union located in axial alignment with the axis of rotation of turntable 16 and directed downwardly towards masking assembly 30. A second mast or support 134 is mounted on the turntable 16 for rotation therewith. This mast includes continuations of the concentric passages in the union which respectively supply air to the tubes 90, 100 for the inflatable tubes 92, 84. In this manner, during rotation of the turntable air is supplied to the tubes, through the rotatable coupling formed by the rotary coupling, even though the turntable is rotated. The rotary union is of conventional constructions and may be of the type sold under the tradename DEUBLIN DEU-PLEX SLOW SPEED ROTATING UNIONS.

When the device is turned on and rotation of turntable 16 commences, a solenoid valve $V_1$ is activated in order to place conduit 126 in communication with the tube 100 supplying air under pressure to tubes 92. This inflates tube 92 and raises frame element 66. After the time period $T_1$ has elapsed frame element 66 has reached its upper position, and a second solenoid valve $V_2$ is activated. This places conduit 126 in communication with the tube 90, supplying air to inflatable tube 84, thereby to expand seal 78.

Air from the main conduit 120 is also supplied to a conduit 144 which is connected to a pair of solenoid valves $V_3$ and $V_4$. After the time period $T_2$ has elapsed, solenoid valve $V_3$ is activated to place conduit 144 in communication with conduit 146. This conduit supplies air to a pilot valve 148 that controls the supply of carbon to nozzle 56. After the passage of time $T_3$, valve $V_3$ is deactivated and valve $V_4$ is activated to connect air conduit 14 to a conduit 150 which is connected to a pilot valve 152 that controls the supply of carbon material to spray nozzle 54.

The carbon coating material is supplied to nozzles 54, 56 through a conduit 154 connected to the carbon tank 128. The conduit passes through a filter 156 to the pressure chamber 158 of a reciprocating pump 160. The pressure side 159 of the pump is connected through a conduit 162 to valves 148, 152 in series. As seen in FIG. 10, each of the valves includes a bypass port 164 which, in the non-spraying position of the valves shown in FIG. 10, permits the carbon to pass through the valves without entering the nozzles 54, 56. The discharge from valve 148 is connected to a conduit 166 which is in turn connected to a valve $V_7$. Normally valve $V_7$ is in the position shown, blocking flow of carbon past conduit 166.

Pump 160 is operated by air pressure supplied through a conduit 170 connected through a pressure regulator 171 to supply line 120. The air from conduit 170 passes through a solenoid valve $V_5$ before entering the piston 172 of reciprocating valve $V_7$. In the non-spraying and non-recirculating position of the valve elements controlling carbon spraying, illustrated in FIG. 10, supply conduit 170 is connected through the port 174 of valve $V_5$ to the lower chamber 178 of piston 172. This keeps valve $V_7$ in its raised position in FIG. 10 blocking passage of carbon from conduit 166.

When valve $V_3$ is turned on, air flows from conduit 144 through conduit 146 to shift valve 148. This connects conduit 162 through valve 152 to nozzle 56, permitting spraying of the tube neck. When time period $T_3$ has terminated, valve $V_3$ is deactivated, returning to the position illustrated in FIG. 10, while valve $V_4$ is activated to permit passage of air from conduit 144 through conduit 150 to valve 152. This connects carbon conduit 162 to nozzle 54. At the same time valve 148 returns to its initial position illustrated in FIG. 10, so that while conduit 166 is opened to valve 152, carbon cannot flow past valve $V_7$, whereby cone spraying takes place during the time period $T_3$–$T_4$.

At the end of the time period $T_4$, valve $V_4$ is deactivated, so that valve 152 returns to its position illustrated in FIG. 10. At the same time valve $V_5$ is activated to shift the valve upwardly, as illustrated in FIG. 10. In that position air from conduit 170 is supplied to the upper chamber 180 of piston 172 and the chamber 178 is connected to exhaust. This shifts valve $V_7$ downwardly, connecting conduit 166 to conduit 182 which returns carbon to the line 154 adjacent carbon tank 128. Since air is still being supplied to pump 160, the pump continues to circulate carbon through conduits 154, 162, 166, 168, insuring proper mixing of the carbon and uniform viscosity therein. After time period $T_4$–$T_5$ has elapsed, valve $V_5$ is deactivated and returned to its original position wherein recirculation of the carbon material is stopped.

When time period $T_5$ has elapsed valve $V_2$ is deactivated and tube 84 evacuated. This is done under the control of the solenoid valve $V_6$. This valve is continuously activated to permit air flow therethrough by a vacuum switch 189 which activates the valve whenever the air pressure in tank 200 is above a desired minimum pressure. Valve $V_6$ is connected through a pressure regulator 190, between conduit 120 and conduit 192. Activation of the solenoid valve connects conduit 120 to conduit 192, which conduit supplies air under pressure to a venturi evacuator 194. This evacuator is connected by a check valve 196 to the exhaust lines 198 of the valve $V_1$–$V_2$. Passage of air through the venturi 194 reduces the air pressure on the downstream side of the check valve 196, causing the check valve to open in response to the pressure in the tubes 94, 84, permitting the air in those tubes to be discharged to the atmosphere. Thus when time $T_5$ has elapsed the mask tube 84 is exhausted and when time $T_6$ has elapsed valve $V_1$ is deactivated and the lifter tubes 92 are exhausted. A vaccum accumulator 200 of conventional construction can be interposed between the lines 198 and the check valve 196, and a continuous vacuum is maintained in the accumulator by the vacuum switch 189 which will control valve $V_6$ to maintain the desired vacuum.

The electrical controls for the various solenoid valves in the pneumatic circuit of FIG. 10 are illustrated in FIG. 8. As seen therein, a switch SW is activated by the operator to turn the device on. Closing switch SW activates the relay CR1 which turns drive motor 50 for turntable 16 on. The drive motor stays on because of the effects of the relays CR1 and $T_6$, while switch SW returns to its open position. The motor stays on until relay $T_6$ is made non-conductive, as described hereinafter.

Activation of switch SW and relay CR1, also cause solenoid $V_1$ to be activated, permitting air to be supplied to lifting tubes 92. At the same time a timer circuit $T_1$ of conventional arrangement, is activated. After the time $T_1$ has elapsed, the timer activates its paired switch $T_1$, thereby activating solenoid valve $V_2$, and timer $T_2$. After the time period $T_2$ has elapsed the timer $T_2$ activates the two switches $T_2$ associated therewith, to in turn activate timer $T_3$, as well as solenoid valve $V_3$ to permit nozzle 54 to spray the neck portion of the cathode ray tube.

After the time period $T_3$ has elapsed, the timer $T_3$ activates its paired switches $T_3$, thereby shutting off valve $V_3$ and activating valve $V_4$, in order to permit spraying of the cone or flared portion of the tube while at the same time activating the timing circuits $T_4$.

After the time $T_4$ has elapsed, the timer $T_4$ activates its paired switches $T_4$, thereby turning the exhaust fan 110 through a separate switch (not shown) and simultaneously operating the switch $T_4$ to shut off valve $V_4$. At the same time timer $T_5$ is turned on by operation of its associated switch $T_4$. This energizes solenoid valve $V_5$ to permit recirculation of the carbon coating material.

After the time $T_5$ has elapsed, the timer $T_5$ activates its paired switch $T_5$ to in turn activate the timer $T_6$. At the same time the solenoid valve $V_5$ is deactivated to stop recirculation of the carbon material and open the switch $T_5$ associated with solenoid $V_2$ to permit venting of tube 84. At the end of the time $T_6$, the switch for exhaust fan 110 is shut off and the paired switch $T_6$ is opened, to shut the apparatus down until the switch SW is reactivated.

Although specific pneumatic and electric control circuits have been described it will be appreciated that these circuits may take a variety of specific forms to accomplish the sequence of operations shown in FIG. 9.

Accordingly it is seen that a relatively simply constructed apparatus is provided which is adapted to coat the inner surface of a cathode ray tube during the manufacturing process, without coating the frit edge of the tube with carbon material. The apparatus is relatively simply constructed and is durable in use. By the use of the apparatus requires a substantial reduction of the manpower usually required to coat the inner surface of cathode ray tubes with conventional manufacturing processes.

Although an illustrative embodiment of the invention has been described herein with reference to the accompanying drawings, it is to be understood that the invention is not limited to that precise embodiment, but that various changes and modifications may be effected therein by one skilled in the art without departing from the scope or spirit of this invention.

What is claimed is:

1. A device for coating a predetermined portion of a cathode ray tube envelope including a neck and a flared portion having an open end defined by a peripheral edge about said flared portion, said neck and flared portions defining an inner surface to be coated; said device comprising a frame, a turntable rotatably mounted on said frame, means on said turntable for supporting a cathode ray tube thereon along at least a portion of said peripheral edge, means mounted on said turntable for selectively forming a seal along a predetermined portion of the flared portion of the tube from adjacent said edge inwardly towards the neck for a predetermined distance, and means in said frame for coating said inner surface of the tube, said means for forming a seal preventing said predetermined portion of the tube from being coated and including a flexible sealing element having a peripheral configuration conforming, in plan, generally to the peripheral configuration of said edge and means for selectively laterally expanding said element outwardly against said predetermined portion of the tube.

2. A device as defined in claim 1 including means for supporting said sealing element on the turntable below the level of the edge of the tube on the first mentioned supporting means, and means for raising said sealing element into the tube through said open end of the tube before it is expanded.

3. A device as defined in claim 2 wherein said sealing element is formed of silicone.

4. A device as defined in claim 1 wherein said coating means includes separate spray nozzles for separately coating the neck and flared portion of the tube.

5. A device as defined in claim 4 including means for separately operating said nozzles in a predetermined sequence.

6. A device for coating a predetermined portion of a cathode ray tube envelope including a neck and a flared portion having an open end defined by a peripheral edge about said flared portion, said neck and flared portions defining an inner surface to be coated; said device comprising a frame, a turntable rotatably mounted on said frame, means on said turntable for supporting a cathode ray tube thereon along at least a portion of said peripheral edge, means mounted on said turntable for selectively forming a seal along a predetermined portion of the flared portion of the tube from adjacent said edge inwardly towards the neck for a predetermined distance, and means in said frame for coating said inner surface of the tube, said means for forming a seal preventing said predetermined portion of the tube from being coated and including a first subframe element mounted on said turntable, a second subframe element mounted for vertical sliding movement with respect to said first subframe element, a flexible sealing strip mounted in said second subframe element and having a peripheral configuration generally conforming to the internal surface of the flared portion of the tube adjacent said peripheral edge, and means for expanding said sealing strip outwardly of said second subframe element into engagement with said predetermined portion of the tube.

7. A device as defined in claim 6 including means on said first subframe element for raising said strip and second subframe element therewith through the open end of the tube to a position wherein the sealing strip is aligned with said predetermined portion of the tube.

8. A device as defined in claim 7 wherein said means for expanding said sealing strip outwardly of said second subframe element includes an inflatable tube mounted in said second subframe element behind the sealing strip with respect to the cathode ray tube, said inflatable tube having a peripheral configuration which is generally complementary to the interior of said strip; and means for selectively inflating said inflatable tube.

9. A device as defined in claim 7 wherein said means for raising said strip and second subframe element comprises at least one inflatable tube engaged with a portion of said second subframe element and means for selectively inflating the last mentioned inflatable tube.

10. A device as defined in claim 9 wherein said second subframe element has an inverted generally L-shaped cross-section with the short leg thereof extending outwardly therefrom and a support flange extending from the long leg thereof parallel to and below said short leg; said sealing strip and the first mentioned inflatable tube being supported on said flange between the flange and said short leg.

11. A device as defined in claim 10 wherein said first subframe element comprises an open frame generally complementary in plan to the short leg of the second subframe element and receiving the long leg of the second subframe element therein; said inflatable tube for raising the sealing strip and second subframe element being supported on said first subframe element between said first subframe element and the flange on said second subframe element.

12. A device as defined in claim 11 including means on said second subframe element for limiting upward movement of said second subframe element with respect to the first subframe element.

13. A device as defined in claim 9 wherein the means for inflating the inflatable tubes includes a source of air under pressure, a first air conduit on said frame extending from said source of air under pressure upwardly to a free end positioned above the neck of a cathode ray tube mounted on the turntable in alignment with the axis of rotation of the turntable, a second conduit mounted on said turntable for rotation therewith having first and second end portions with the first end portion thereof aligned with said free end of the first conduit for receiving air under pressure therefrom and means for connecting said second end portion of the second conduit to said inflatable tubes.

14. A device as defined in claim 13 wherein said connecting means comprises a pair of selectively operable valves.

15. A device as defined in claim 1 including means for exhausting air and ambient coating material from the interior of the cathode ray tube after coating.

16. A device for coating the inner surface of a cathode ray tube with a carbon material wherein the cathode ray tube has a neck and a flared end portion having an open end remote from the neck defined by a free peripheral edge portion to which a front tube panel is secured after coating, said device comprising, a base, a turntable rotatably mounted on said base, means on said turntable for supporting a cathode ray tube along the free edge thereof in a predetermined fixed position, said turntable having an opening formed therein at said predetermined position, and seal assembly means mounted on said turntable in said opening for selectively forming a seal on the inner surface of the flared portion of the cathode ray tube adjacent said free edge thereof, said seal assembly means including a first frame element secured to said turntable, a second frame element slidably mounted on said first frame element for vertical movement, a flexible sealing strip mounted on said second frame element and having an exterior peripheral configuration, in plan, which is generally complementary to the internal peripheral configuration of said predetermined portion of the cathode ray tube, means for moving said second frame element and sealing strip thereon vertically away from the first frame element through said open end of the cathode ray tube, and means for expanding said sealing strip laterally outwardly with respect to the second frame element into sealing engagement with said predetermined portion of the cathode ray tube; means for rotating the turntable, and means in said base adjacent the opening in said turntable for spraying carbon coating material onto said inner surface of the cathode ray tube whereby said sealing strip prevents said predetermined portion of the tube from being coated.

17. A device as defined in claim 16 wherein said means for expanding said sealing strip laterally outwardly comprises a hollow flexible tube surrounding a portion of said second frame element and being positioned between said second frame element and said sealing strip; and means for selectively inflating said flexible tube thereby to expand said sealing strip laterally outwardly.

18. A device as defined in claim 17 wherein said means for moving said second frame element and sealing strip comprises at least one hollow flexible tube operatively engaged between said first frame element and said second frame element and means for inflating the last mentioned flexible tube.

19. A device as defined in claim 18 wherein said open end of the cathode ray tube and the peripheral configuration of the sealing strip are generally rectangular.

20. A device as defined in claim 18 wherein said sealing strip is formed of silicone.

21. A device as defined in claim 18 wherein said spraying means comprises a pair of separate spray nozzles for separately coating the inner surfaces of the neck and flared portion of the tube.

22. A device as defined in claim 21 including means for separately operating said nozzles in a predetermined sequence.

23. A device as defined in claim 18 wherein said second frame element has an inverted generally L-shaped cross-section including a first vertically extending leg received within said first frame element and a second leg extending perpendicularly therefrom and outwardly of the second frame element above and in spaced superimposed relation to said first frame element; and a seal support flange extending perpendicularly outwardly of said first leg between said second leg and said first frame element; said sealing strip and the first mentioned inflatable tube being supported on said flange between said flange and said second leg.

24. A device as defined in claim 23 wherein said flange includes a perpendicularly upwardly extending flange located in spaced parallel relation to said first leg confining said sealing strip between the lip and said first leg; said lip terminating in spaced relation to said second leg to define a slot therebetween; said sealing strip including a seal portion extending outwardly through said slot whereby, upon inflation of said first mentioned flexible tube, the portion of the sealing strip extending through the slot is moved outwardly while said lip holds the sealing strip on the second frame element.

25. A device as defined in claim 24 wherein said first frame element comprises an open frame generally complementary in plan to said second leg of the second frame element and defining an opening which receives the first leg of the second frame element; said at least one hollow flexible tube for raising the second frame element with respect to the first frame element comprising a pair of parallely extending tubes seated on the first frame element in spaced parallel relation on opposite sides of the opening in the first frame element below, and in engagement with the flange on the second frame element.

26. A device as defined in claim 25 including means on said second frame element for limiting upward movement of said second frame element with respect to the first frame element.

27. A device as defined in claim 18 wherein the means for inflating the hollow flexible tubes includes a source of air under pressure, a first air conduit on said base extending from said source of air under pressure upwardly to a free end positioned above the neck of a cathode ray tube mounted on the turntable in alignment with the axis of rotation of the turntable; a second conduit mounted on said turntable for rotation therewith having first and second end portions with the first end portion thereof aligned with said free end of the first conduit for receiving air under pressure therefrom and means for connecting said second end portion of the second conduit to said inflatable tubes.

28. A device as defined in claim 27 wherein said connecting means comprises a pair of selectively operable valves.

29. A device as defined in claim 16 including means for exhausting air and ambient spraying material from the interior of the cathode ray after spraying.

30. A seal assembly for use in selectively forming a temporary coating seal on a predetermined portion of the inner surface of a cathode ray tube, having a neck and flared portion, adjacent the open end of the tube during a coating operation, said assembly including a first peripheral frame element defining a central opening therein, a second frame element slidably mounted on said first frame element for relative movement towards and away from the first frame element, a continuous flexible sealing strip mounted on said second frame element and having an exterior peripheral configuration, in plan, which is generally complementary to the internal peripheral configuration of said predetermined portion of the cathode ray tube, means for moving said second frame element and sealing strip thereon away from the first frame element through the open end of a cathode ray tube supported adjacent the assembly, and means for expanding said sealing strip laterally outwardly with respect to the second frame element into sealing engagement with said predetermined portion of the cathode ray tube.

31. A device as defined in claim 30 wherein said means for expanding said sealing strip laterally outwardly comprises a selectively inflatable hollow flexible tube surrounding a portion of said second frame element and being positioned between said second frame element and said sealing strip.

32. A device as defined in claim 31 wherein said means for moving said second frame element and sealing strip with respect to said first frame element comprises at least one hollow flexible tube operatively engaged between said first frame element and said second frame element.

33. A device as defined in claim 32 wherein said sealing strip is formed of silicone.

34. A device as defined in claim 32 wherein said second frame element has an inverted generally L-shaped cross-section including a first vertically extending leg received within said first frame element and a second leg extending perpendicularly therefrom and outwardly of the second frame element above and in spaced superimposed relation to said first frame element; and a seal support flange extending perpendicularly outwardly of said first leg between said second leg and said first frame element; said sealing strip and the first mentioned inflatable tube being supported on said flange between said flange and said second leg.

35. A device as defined in claim 34 wherein said flange includes a perpendicularly upwardly extending flange located in spaced parallel relation to said first leg confining said sealing strip between the lip and said first leg; said lip terminating in spaced relation to said second leg to define a slot therebetween; said sealing strip including a seal portion extending outwardly through said slot whereby, upon inflation of said first mentioned flexible tube, the portion of the sealing strip extending through the slot is moved outwardly while said lip holds the sealing strip on the second frame element.

36. A device as defined in claim 35 wherein said first frame element comprises an open frame generally complementary in plan to said second leg of the second frame element and defining an opening which receives the first leg of the second frame element; said at least one hollow flexible tube for raising the second frame element with respect to the first frame element comprising a pair of parallely extending tubes seated on the first frame element in spaced parallel relation on opposite sides of the opening in the first frame element below, and in engagement with the flange on the second frame element.

37. A device as defined in claim 35 including means on said second frame element for limiting movement of said second frame element with respect to the first frame element.

* * * * *